United States Patent [19]

Godwin

[11] Patent Number: 4,834,630

[45] Date of Patent: May 30, 1989

[54] PERISTALTIC PUMP

[76] Inventor: Darwin D. Godwin, 1083 Lakeview Dr., Mount Gilead, N.C. 27306

[21] Appl. No.: 159,500

[22] Filed: Feb. 16, 1988

Related U.S. Application Data

[63] Continuation-in-part of Ser. No. 113,753, Oct. 27, 1987, abandoned.

[51] Int. Cl.[4] ..... F04B 43/12
[52] U.S. Cl. ..... 417/475; 417/477
[58] Field of Search ..... 417/474, 475, 476, 477

[56] References Cited

U.S. PATENT DOCUMENTS

| | | | |
|---|---|---|---|
| 1,922,196 | 8/1933 | Butler | 417/475 |
| 2,913,992 | 11/1959 | Blue et al. | 417/475 |
| 4,233,001 | 11/1980 | Schmid | 417/475 |
| 4,289,459 | 9/1981 | Neeley et al. | 417/477 X |
| 4,397,639 | 8/1983 | Eschweiler et al. | 417/477 X |
| 4,496,295 | 1/1985 | King | 417/477 |

FOREIGN PATENT DOCUMENTS

| | | | |
|---|---|---|---|
| 82/03427 | 10/1982 | PCT Int'l Appl. | 417/477 |
| 83/01984 | 6/1983 | PCT Int'l Appl. | 417/477 |

OTHER PUBLICATIONS

Cole-Palmer Catalog, 1987-1988, pp. 645, 688, 690, 691 and 693, published 1986.

*Primary Examiner*—Carlton R. Croyle
*Assistant Examiner*—Eugene L. Szczecina, Jr.

[57] ABSTRACT

A peristaltic pump is disclosed which facilitates accurate fluid distribution through a plurality of conduits. A stator is provided having an elongated rotor with stabilizers therein for typical fluid movement by compression of the conduits along the stator wall. The conduit inlets are positioned within reservoir attached to the stator and the conduit inlets include high tolerance ID fittings which prevent inlet closure and assists in maintaining an even, uniform fluid flow through the conduits. One embodiment of the pump includes a segmented rotor with rollers alternately arranged in each segment.

18 Claims, 4 Drawing Sheets

PERISTALTIC PUMP

This is a continuation-in-part of pending patent application Ser. No. 113,753 filed Oct. 27, 1987 now abandoned.

BACKGROUND OF THE INVENTION

1. Field of the Invention

The present invention relates generally to fluid pumps and more specifically to peristaltic pumps of the type operative to effect a moving region or regions of compression along a compressible fluid conduit.

2. Description Of The Prior Art And Objectives Of The Invention

Various types of peristaltic pumps are known in industry for delivery of many fluids whether liquid or semi-liquid and other substances which, for example, may be highly corrosive or abrasive in nature. Such pumps generally have a pivotable rotor and a stator and positioned therebetween are one or more compressible conduits which may be formed from rubber, neoprene or other natural or synthetic materials. In conventional pumps and even in multi-conduit peristaltic pumps, the variation in delivery capacity among particular conduits in any time interval may be as high as fifteen percent (15%) due to a number of factors including variation in the ID of the conduits during extrusion and manufacture. In critical metering (pumping) operations such variation cannot be tolerated.

Other types of pumps and devices such as piston pumps and gear pumps have been used in an attempt to provide a consistent, uniform fluid delivery over extended time periods but these pumps have oftentimes been unsuccessful in precise applications where small, fractional cc's of fluid delivery per revolution are desired. The gear pumps may provide a uniform flow initially but deteriorate rapidly unless the material being pumped is such that it acts as a lubricant.

With the aforesaid drawbacks, variation of delivery, inaccuracy and disadvantages of conventional peristaltic and other pumps, it is one object of the present invention to provide a pump having ± two-and-one-half percent (2½%) delivery accuracy among conduit outlets, as many as thirty-six (36) or more, even when measured over extended time periods such as three (3) months.

It is also an object of the present invention to provide a peristaltic pump having a plurality of fluid outlets for equal, accurate, simultaneous fluid supply.

It is yet another object of the present invention to provide a peristaltic pump having an elongated rotor and stator with the rotor being bearingly supported and having a stabilizer therein.

It is still another object of the present invention to provide a peristaltic pump with a fluid reservoir mounted on the stator and in communication with a plurality of compressible fluid conduits.

It is still yet another object of the present invention to provide a compressible conduit having a fluid inlet with a rigid fitting therein to insure uniform fluid entry.

It is also an objective of the invention to provide a peristaltic pump having a segmented rotor with staggered rollers therein.

Various other objects and advantages of the present invention will be contempated by those skilled in the art as a more detailed description of the invention is presented below and shown in the drawings.

SUMMARY OF THE INVENTION

A peristaltic pump is provided having an elongated rotor with a plurality of rollers for contacting and simultaneously compressing multiple conduits against the interior stator walls. The rotor has one or more stabilizers to insure even compression along the rollers and to prevent the rotor from "twisting" as it revolves. A reservoir is mounted atop the stator and the ends of the conduit terminate in the reservoir for fluid ingress and passage therethrough. The ends of the conduits or inlets within the reservoir are provided with a rigid insert of sufficient length and little or no variation in the ID of the insert or fitting to insure that the ends do not collapse or partially close during use thereby limiting the fluid flow therein.

In one embodiment of the pump a rotor is provided having segments with the rollers arranged in an alternating manner.

DESCRIPTION OF THE PREFERRED EMBODIMENT

Figure 1:
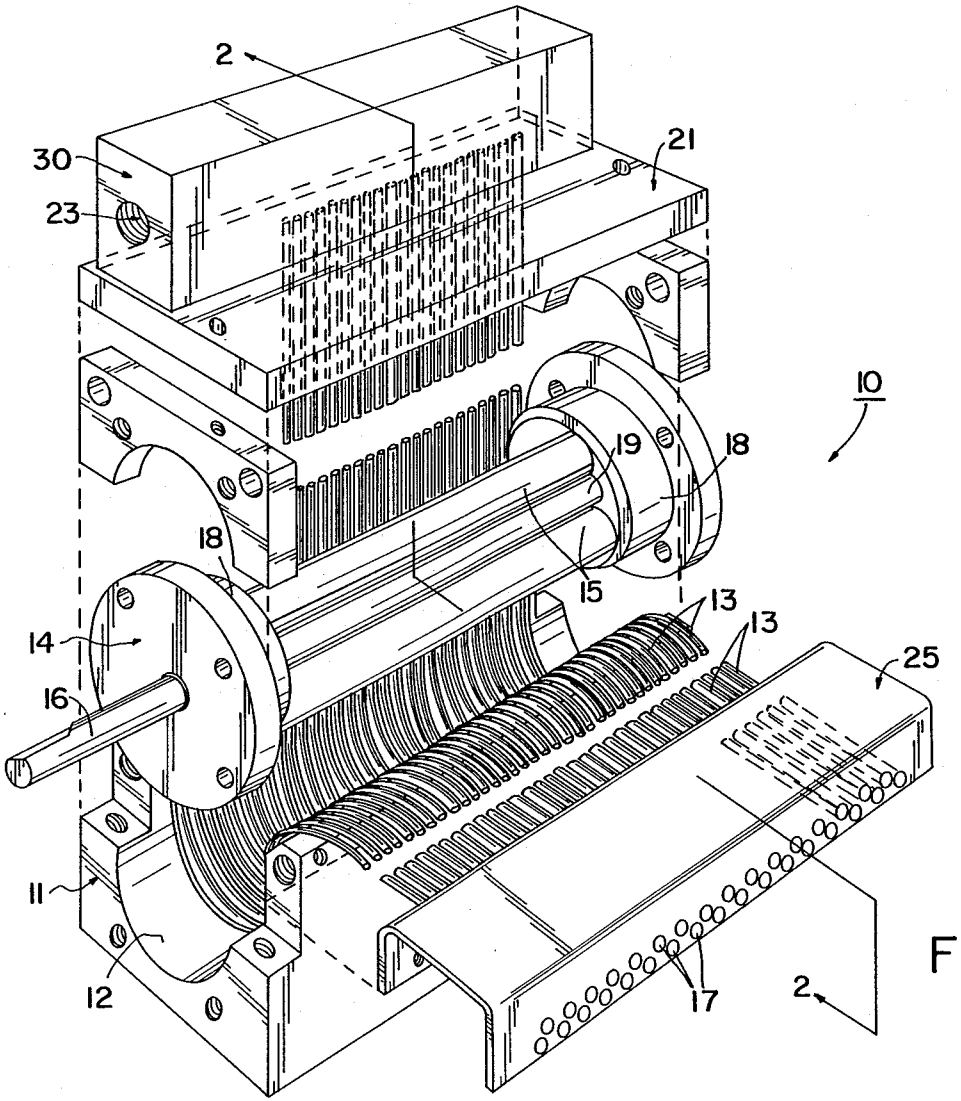
FIG. 1 is a perspective exploded view of the peristaltic pump of the invention.

The preferred form of the invention comprises a peristaltic pump having a plurality of thirty-two (32) compressible conduits therewith. A rotor having end bearings and a drive shaft affixed at one end thereof is mounted in a stainless steel stator with a u-shaped rotor chamber as seen in a transverse view. The rotor also includes three (3) rollers and positioned proximate the rollers are three (3) rigidly affixed torsion stabilizers consisting of solid, rigid stainless steel rods which are attached at each end to the bearings. The inlet ends of the conduit are positioned above the stator in a reservoir base having thereon a reservoir for holding fluids such as water, oil or the like. The inlet ends of the conduit which are inserted through the reservoir base contain a stiff hollow tubular fitting formed from stainless steel or the like to insure the compressible conduit inlet ends remain uniformly open to receive fluid. The stainless steel fittings within the conduit inlets have an inside diameter (ID) of thirty thousands (30,000) of an inch whereas the inside diameter (ID) of the conduits may be thirty-two thousands (32,000) of an inch and outside diameter (OD) of the conduits may be for example one hundred sixty thousands (160,000) of an inch and may be formed from neoprene or other chemical-resistant, natural or synthetic compressible, suitable materials. The fluid reservoir has one or more fluid inlets and can be gravity fed or otherwise supplied with desired fluids to insure an ample supply for the conduits during pump operation.

DETAILED DESCRIPTION OF THE DRAWINGS AND OPERATION OF THE INVENTION

Figure 2:
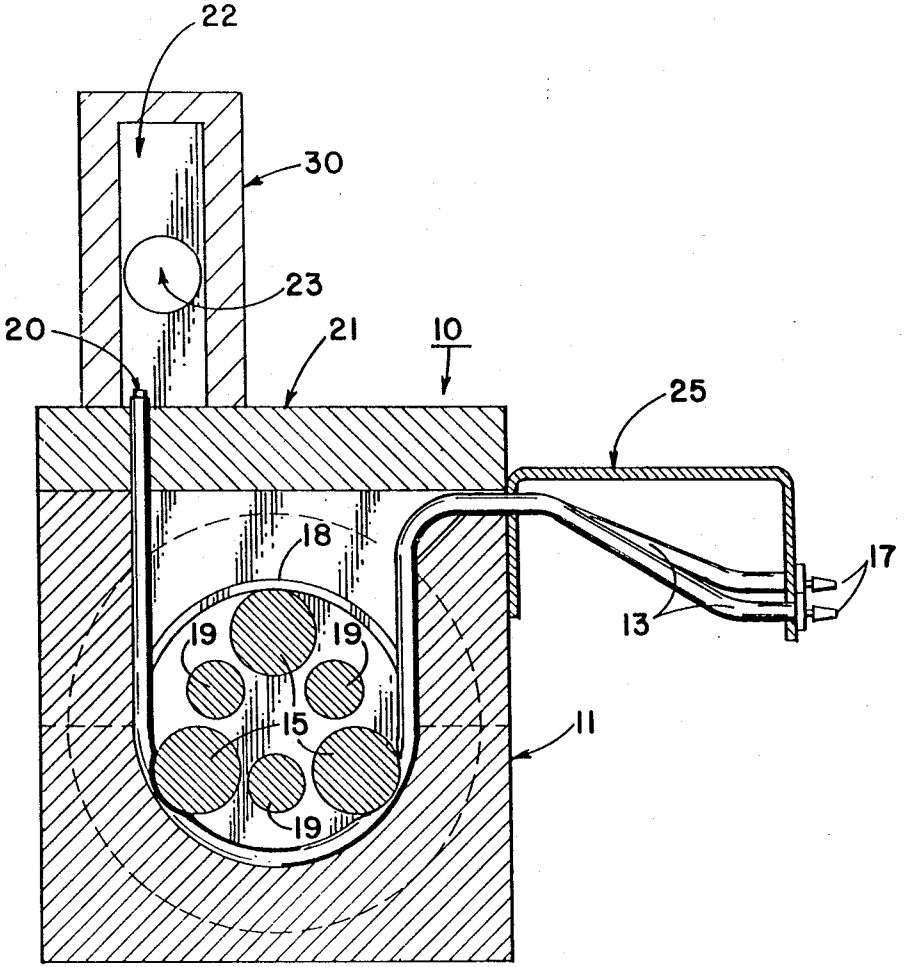
FIG. 2 demonstrates in cross-sectional fashion the rotor, conduit and stator with the reservoir removed.

Turning now to the drawings, FIG. 1 illustrates multi-outlet peristaltic pump 10 in exploded fashion having stator 11 formed from a block of stainless steel to provide long life and simplicity in repair and maintenance. Stator 11 has rotor chamber 29 which is substantially u-shaped as seen from one end as in FIG. 1 and inner surfaces 12 of chamber 29 are polished for smooth, even compression of conduits 13 by rotor 14 during use and operation of pump 10. Conduit 13 is formed from a durable, resilient, abrasive-resistent material and as shown in FIG. 2, rotor 14 revolves through end bearings 18 and rollers 15 turn along and compress conduit 13 forcing fluid therein from right to left as shown in Fi. 2. Rotor 14 is driven by the rotation of drive shaft 16 by a gear motor or the like (not seen). Conduits 13 can vary in size and can conveniently be used to pump oil for lubricating fibers in textile operations such as during fiber extrusion, texturing, knitting or certain weaving operations. Conduits 13 may, for example, have inside diameters of only thirty-two thousands (32,000) of an inch and outside diameters of one hundred sixty thousands (160,000) of an inch and as mentioned hereinbefore, are formed from a suitable synthetic or natural material for long life and abrasion and corrosion resistance. Conduit 13 as shown herein with its thirty-two thousands (32,000) of an inch ID is sufficiently sized to supply one-half (½) gram per minute of oil to, for example, a forty (40) denier nylon yarn and each revolution of rotor 14 delivers 0.08 (eight one-hundredths) cc of oil per revolution. As would be understood by varying the rotational speed of rotor 14 and by varying the diameter of conduit 13 or by modifying other factors such as the oil viscosity, more or less oil can be forced through conduit outlets 17 as shown in FIG. 1. A typical installation of peristaltic pump 10 as shown in FIG. 1 may be require thirty-two (32) conduit outlets 17 for supplying oil to thirty-two (32) yarn operations on one machine or at one plant location. It is of paramount importance that each yarn strand be supplied with the identical amount of oil per unit (revolution or time) in order for the manufacturer of the yarn to supply yarn with uniform weight and processing characteristics.

It has been determined that rotor 14, for the most consistent results must include end bearings 18 at each end of rotor 14 with said bearings firmly affixed to stator 11. Since rotor 14 is elongated, it has likewise been discovered that torsion stabilizers 19 are also necessary to provide even compression of conduits 13 from end to end along rotor 14. Stabilizers 19 comprise rigid stainless steel rods which prevent rotor 14 from undergoing torquing along the longitudinal axis of rotor 14 as it revolves.

Figure 3:
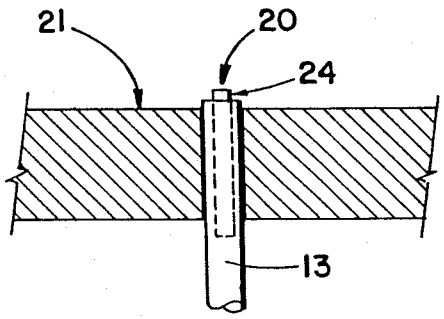
FIG. 3 illustrates the inlet end of the conduit in enlarged fashion in the reservoir base.

It has also been realized that compressible conduits 13 in conventional feed systems may weaken and collapse or partially close at their inlets 20 as shown in FIG. 3. Conduit inlets 20 of conduit 13 are mounted in reservoir base 21 and are supplied fluid from reservoir 30 such as water, oil or the like by reservoir tank 22. Reservoir tank 22 is in turn supplied through reservoir tank inlet 23 as shown in FIG. 1 from a larger tank (not shown) or other supply sources. In use with certain chemicals, conduit inlets 20 may become soft and tend to partially close after extended use. In order to prevent such inadverent closure, stainless steel tubings or fittings 24 are inserted in conduit inlets 20 a sufficient depth through reservoir base 21. Fittings 24 thus provide a rigid uniform opening and ID for inlets 20 under adverse environmental conditions and during long term use and assist pump 10 in a consistent fluid delivery along conduit outlets 17. Fluid reservoir 30 is formed from an inert polymer substance such as Teflon and can be sized to adequately provide multiple conduit inlets 20 as required.

Outlet frame 25 is attached to stator 11 and may be made from suitable materials such as stainless steel or Teflon and maintains conduit outlets 17 in steady, fixed positions for attachment to fluid lines for delivery to specific machine or plant locations as required.

Figure 4:
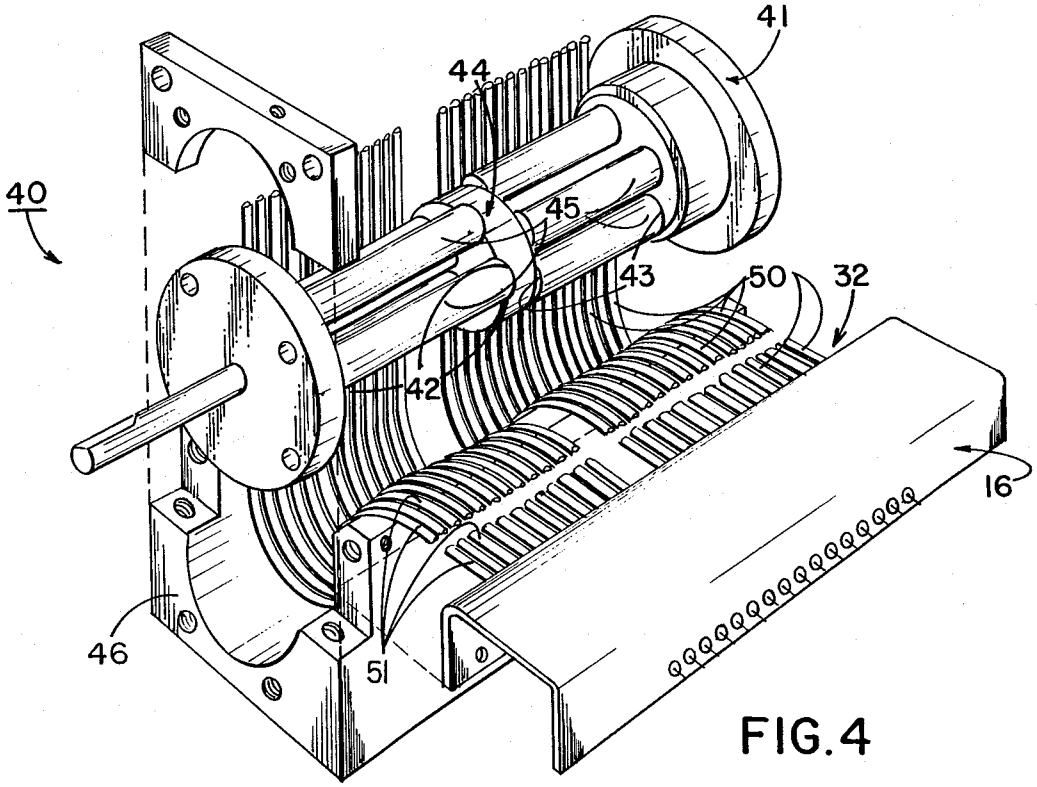
FIG. 4 shows another embodiment of the pump in partical perspective fashion with the rotor having alternating rollers exploded from the stator.

Peristaltic pump 40 as shown in FIG. 4 includes rotor 41 having 2 segments, left segment 42 and right segment 43. Segments 42 and 43 are joined by roller hub 44 and rollers 45 are free to rotate as roller 41 turns within stator 46. It is understood from FIG. 4, as rotator 41 rotates, for example, segment 42 first contacts compressible conduit 13 and as rotor 41 continues to turn, a roller 45 of segment 43 would later contact another conduit 13 in an alternating or staggered manner due to the mounting of rollers 45 in segments 42 and 43. Rollers 45 in FIG. 4 and rollers 15 described above are each rotable individually and rotate with rotor 41. A plurality of rollers 45 is utilized in each segment and four (4) rollers per segment has been found effective for most uses.

Figure 5:
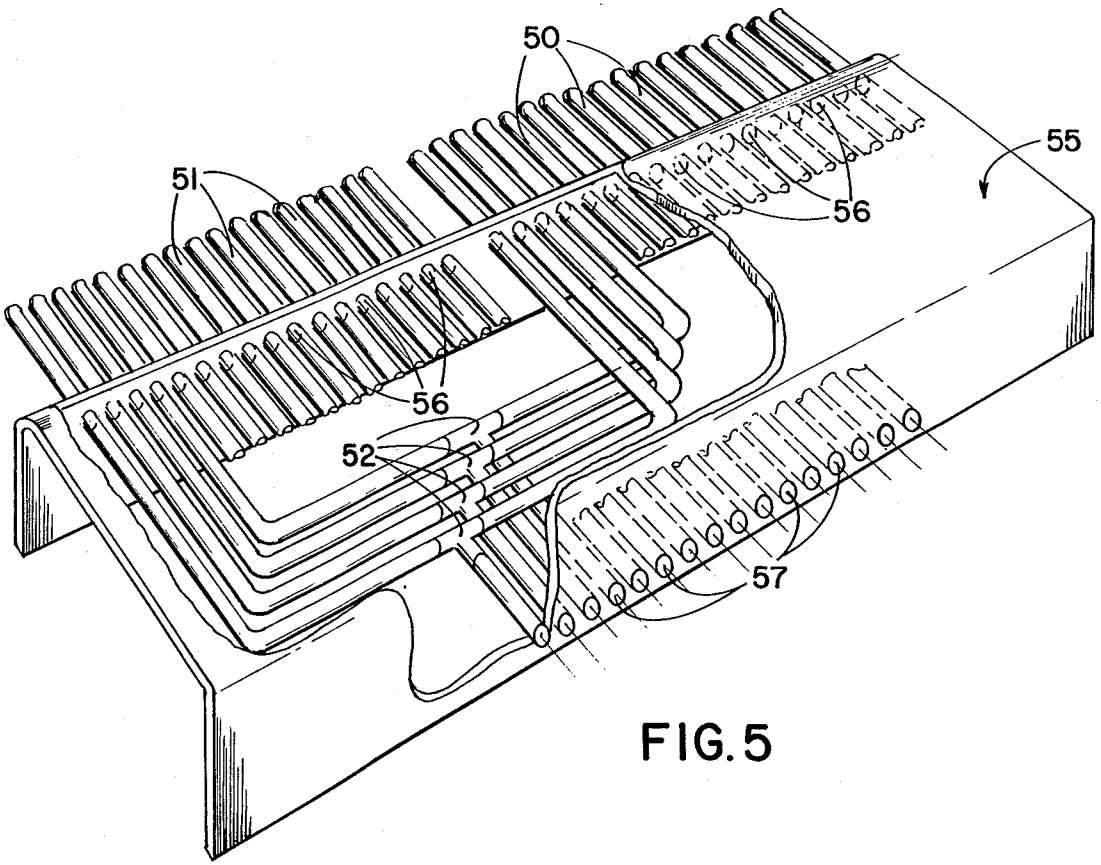
FIG. 5 depicts a cut-away view of the outlet frame as would be used with the pump shown in FIG. 4.

It has been found that with a segmented rotor 41 as shown in FIG. 4 the pulse action of pump 40 can be greatly reduced and will virtually appear as a single stream as may be required for highly specialized, precise applications by connecting right conduit 50 and left conduit 51 by t-shaped coupler 52 as shown in FIG. 5. As further shown in FIG. 5, frame 55 has twice the inlet ports 56 as outlet ports 57 as coupler 52 reduces the number of supply conduits in half. In order to insure a "pulseless" flow through outlet ports 57, right conduit 50 and left conduit 51 must be of proper length from the respective rollers 45 to coupler 52 so the alternating fluid pulses will arrive at coupler 52 at opposite times during the flow cycle. If the arrival times are not equally spaced during the cycle the pulse flow will be maintained and even increased. Various shapes can be used and it is envisioned that two or three or more conduits could be joined to supply a single outlet to further reduce the pulse action of the liquid as it is pumped and more than two (2) rotor segments per rotor may be used in certain instances.

The illustrations and examples provided herein are for explanatory purposes and are not intended to limit the scope of the appended claims.

I claim:

1. A peristaltic pump comprising: a stator, a segmented rotor, said rotor revolvable within said stator, each of said rotor segments having a roller, said roller of one of said segments being alternately axially aligned with said roller of said other segment, compressible conduit, said conduit positioned between said rotor and said stator, a fluid reservoir, said reservoir proximate said stator, said fluid reservoir in communication with said conduit whereby fluid within said reservoir enters said conduit and is directed therethrough by the rotation of said rotor.

2. A peristaltic pump as claimed in claim 1 and including a plurality of conduits.

3. A peristaltic pump as claimed in claim 1 wherein said conduit includes a rigid inlet fitting positioned therein.

4. A peristaltic pump as claimed in claim 1 wherein said conduit has an inlet and an outlet end.

5. A peristaltic pump as claimed in claim 1 wherein said conduit is formed from a compressible material.

6. A peristaltic pump as claimed in claim 1 wherein said rotor includes a pair of end bearings and a roller, said roller rotatably mounted between said end bearings.

7. A peristaltic pump as claimed in claim 6 and including a stabilizer, said stabilizer rigidly affixed between said end bearings.

8. A peristaltic pump as claimed in claim 1 wherein said reservoir is attached to said stator.

9. A peristaltic pump as claimed in claim 8 wherein said reservoir is attached to the top of said stator.

10. A peristaltic pump as claimed in claim 1 wherein said reservoir includes a base, and said base is attached to the top of said stator.

11. A peristaltic pump as claimed in claim 10 wherein said base defines a plurality of conduit openings.

12. A peristaltic pump as claimed in claim 1 wherein said reservoir defines a liquid inlet.

13. A peristaltic pump as claimed in claim 1 wherein said stator has a smooth inner wall surface.

14. A peristaltic pump as claimed in claim 1 and including a plurality of rollers in each segment.

15. A peristaltic pump having a stator, a rotor, said rotor rotatably mounted in said stator, compressible conduit, said conduit positioned in said stator for compression and fluid movement therethrough by the rotation of said rotor, the improvement comprising: a segmented rotor having first and second segments, and each of said rotor segments having a plurality of rollers, each of said rollers in said first segment positioned in alternate axial alignment to said rollers in said second segment.

16. A peristaltic pump comprising: a stator, a rotor having a plurality of segments, said rotor positioned within said stator, said segments having a plurality of rollers, said rollers of adjoining segments positioned in alternate axial alignment, a stabilizer, said stabilizer rigidly mounted between said end bearings, a compressible conduit, said conduit positioned between and in contact with said rotor and said stator for directing fluid flow therethrough as said rotor turns within said stator.

17. A peristaltic pump as claimed in claim 16 and including a fluid reservoir, said reservoir attached to said stator and said reservoir in fluid communication with said conduit.

18. A peristaltic pump as claimed in claim 17 wherein said conduit includes an inlet, said inlet terminating within said reservoir, a rigid fitting, said rigid fitting positioned within said inlet to prevent closing of said inlet.

* * * * *